US005581807A

United States Patent [19]

Peterson

[11] Patent Number: 5,581,807

[45] Date of Patent: Dec. 10, 1996

[54] VISOR CAP

[76] Inventor: William R. Peterson, 26 Barclay Dr., Turnersville, N.J. 08012

[21] Appl. No.: 476,701

[22] Filed: Jun. 7, 1995

[51] Int. Cl.[6] ..... A42B 1/06

[52] U.S. Cl. ..... 2/10; 2/181; 2/209.13

[58] Field of Search ..... 2/6.3, 6.5, 6.7, 2/9, 10, 12, 15, 173, 181, 181.2, 181.4, 181.6, 181.8, 182.8, 206, 209.13, 424, 453; 351/155

[56] References Cited

U.S. PATENT DOCUMENTS 1,781,832 11/1930 Crenshaw ..... 2/10

2,462,258 2/1949 Dannenberg ..... 2/10

*Primary Examiner*—Diana Biefeld

*Attorney, Agent, or Firm*—Paul Maleson

[57] ABSTRACT

Headgear including a light-filtering visor. The headgear may be of any applicable type, including caps, hats, and headbands. The light-filtering visor may be flipped downward to an operative position and upwards to an inoperative position. In the operative position, the filter is positioned generally vertically in front of the eyes of the user. In the inoperative position the visor extends generally upwardly and within the headgear. Means are provided to restrain the folding or flipping action of the visor so that it extends downwardly rather than horizontally in the downwardly-flipped operative position. The visor has two stable positions, upwardly and downwardly.

9 Claims, 3 Drawing Sheets

VISOR CAP

BACKGROUND OF THE INVENTION

1. Field of the Invention

This invention relates to caps and other head coverings. The caps can be with or without a bill. The invention is applicable to hats and to items designed to be worn on the head which do not in themselves qualify as caps or hats. For example, this invention is applicable to head bands which include an eye shade.

There is some confusion in the nomenclature as to the meaning of the term "visor". In this patent, an extension of the crown of a hat or cap or head covering which extends generally forward, and for example casts a shade on the eyes, is called a "bill" or a "brim". The term "visor", as used herein, is restricted to a transparent lens or shield or screen to be operatively positioned in front of the eyes of the user.

The present invention has its most apparent and immediate utility in connection with caps of the type that have a forward extending bill. Such caps are often described as baseball caps. Throughout the specification, for ease of reference and economy of words, reference will always be made to a "cap", and the drawings use a cap as an illustrative example for the invention.

The present invention contemplates a sunscreen or anti-glare visor or light-reducing screen which is permanently attached to the cap, and which is capable of being stored in a non-operative condition inside the cap or in an operative condition, extending downwardly in front of the eyes of the user.

2. Prior Art

This is a crowded art, and there have been a number of developments in which a visor or sunscreen is combined with a headgear such as a cap or hat. In almost all of the known expedients, the position of the visor is fixed, and where it is not, the structure and function differs from that of the present invention.

Prior art of interest includes patents to: Fosher, U.S. Pat. No. 4,386,437; Liataud, U.S. Pat. No. 4,815,838; Lynd et al, U.S. Pat. No. 5,105,475; Wheeler, U.S. Pat. No. 5,007,109; Bedient, U.S. Pat. No. 5,197,150; Okamura, Sr., U.S. Pat. No. 4,556,993; Kelman, U.S. Pat. No. 5,208,916; and Gerhardt, U.S. Pat. No. 4,551,859.

Patents to Kelman, Okamura, Bedient and Wheeler have visors but they are not believed to flip up and down as in the present invention. The patents to Lynd and Liataud are headband type devices that have bills as well as visors, but they are not believed to flip in and out of operative positions as in the present invention. The Fosher patent does show storage means inside the crown of the baseball-type cap, but the structure and function are different. The Gerhardt patent does not relate to eye protection but does relate to a cap with self-storing ear flaps. While the Gerhardt ear flaps do flip up and down, they are always biased toward wanting to flip inward and upwardly into the crown of the cap, and in their operative position, it is only the pressure against the ears of the users that keeps the flaps from folding up. Such a mechanism is desirable to keep what amount to earmuffs tight against the ear, but it is not what is desired in connection with an eye visor.

In contradistinction, the present invention provides two stable positions for the visor; stored inside the crown and flipped down in front of the face.

Just as the term "cap" used herein broadly means any type of head wear, the term "visor" used herein means anything that might otherwise be described as a sunscreen or sun shield or anti-glare screen or filter or the like.

SUMMARY OF THE INVENTION

This invention relates to head gear, illustratively described as caps, and typically being provided with a forward extending bill or shading device. It includes a transparent visor. The transparent visor of the present invention is provided at the front of the cap. It has two stable positions. One is the down or operative position in which the eyes of the wearer are protected or shielded. The visor is generally configured so that the when it is in the lowered or operative position, it covers and protects the eyes of the wearer, and preferably has a cut-out center section to accommodate the wearer's nose, while crossing over the bridge of the nose.

The other position is the up, or storage, or inoperative position. In the inoperative position, the visor has been flipped upward into the interior of the crown or main portion of the cap, and rests in contact with or adjacent to the interior surface of the crown of the cap. When the cap is worn by the user in the up or storage or inoperative position, the visor is completely concealed and observers of the user are not aware of its existence.

The two positions are "flip" positions. That is, the visor may be flipped into either of these positions and is stable in one or the other of them.

The attachment edge of the visor to the cap follows a curve around the rim of the cap. This geometry contributes to the two stable "flip-flop" positions.

DESCRIPTION OF THE PREFERRED EMBODIMENTS

Figure 1:
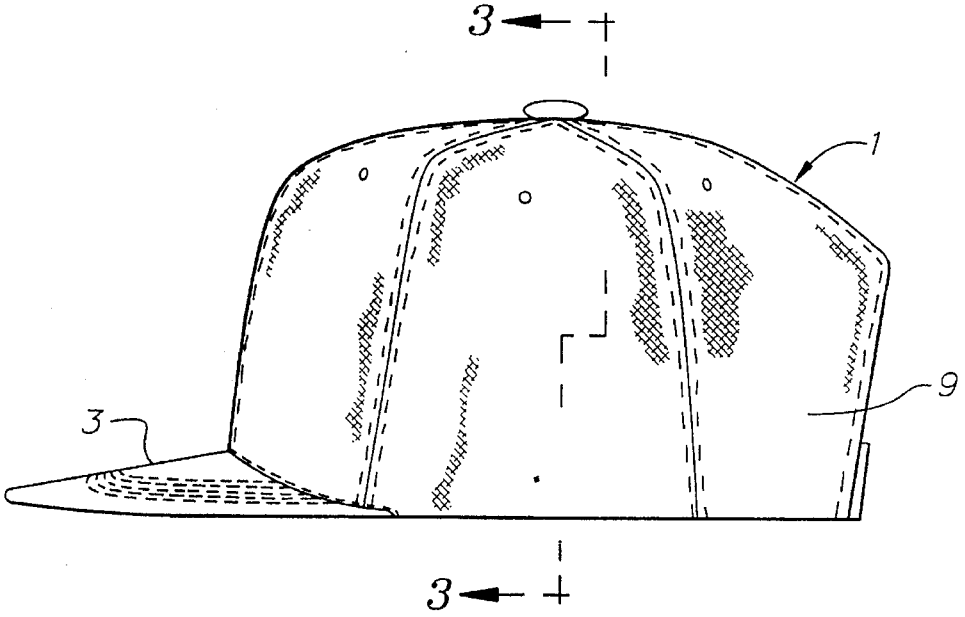
FIG. 1 is a side view of one embodiment of the cap with the visor in the stored and thus concealed position.

FIG. 1 best initially shows a side elevation view of a cap, generally designated 1, having an outer surface 9 and a bill 3. The bill 3 is a generally horizontally extending piece which shades the eye. This element of a cap is sometimes called a visor, but in this patent, the term visor is reserved for another element. FIG. 1 shows the cap 1 with the visor in an invisible, inoperative, flipped-up position, hidden in this view inside the cap.

Figure 2:
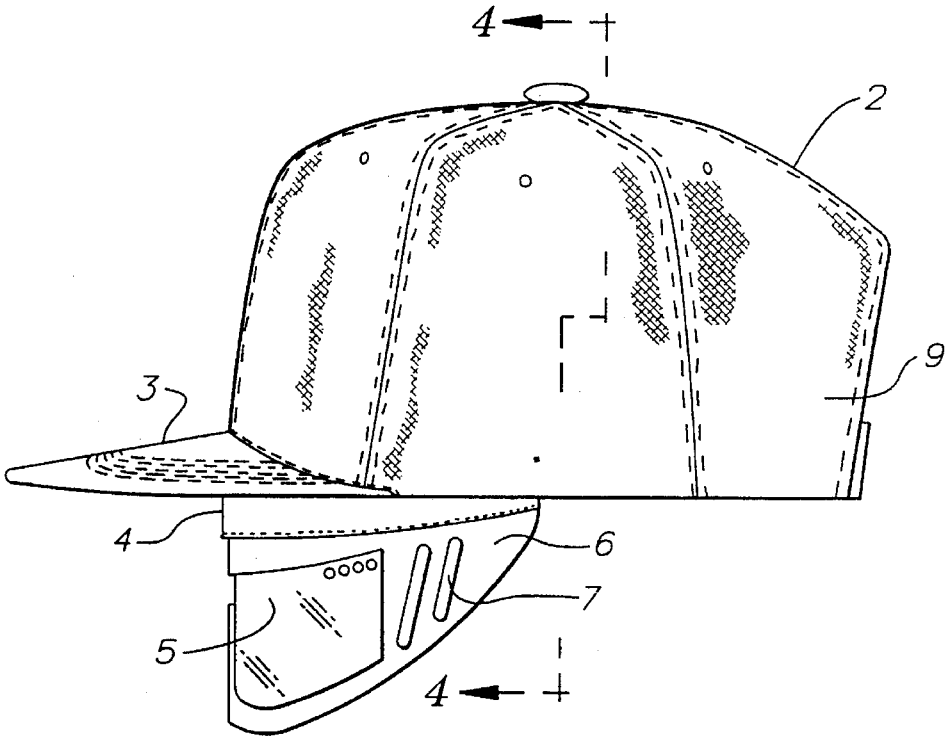
FIG. 2 is a side view of the cap with the visor in the lowered or operative position.

FIG. 2 is a side elevation view of the cap, generally designated 2, differing from the view of FIG. 1 in that in the FIG. 2 view, the visor, generally designated 4 is in the lowered, or flipped-down, or operative position. In this position, the visor 4 provides a direct in front of the eyes filter or sunscreen. The visor 4 includes a transparent filter 5 having some degree or form of light filtering quality. Generally and typically, this light filter 5 is a flexible thin plastic material which is tinted to screen out the sun's rays. The nature of the coloring or tint, and whether it has ultra-violet shielding qualities or not, and if so, how much, are matters of conventional technology and do not in themselves constitute a novel portion of this invention.

Preferably, the visor 4 also includes a heavier gauge, opaque, portion 6. This heavier gauge portion is preferably made of cross-linked ⅛" foam plastic. Preferably also, the opaque portion 6 is provided with ventilation openings 7, here illustrated as extended slots. Preferably also, the light filter 5 is provided with one or more filter ventilation openings 8, here shown as four small holes on each side of the visor. The ventilation openings as described above, while preferable, are not absolutely essential to the operative principle of the present invention. It is noted that the bill 3 extends generally horizontally, the visor 4 extends generally vertically.

Figure 3:
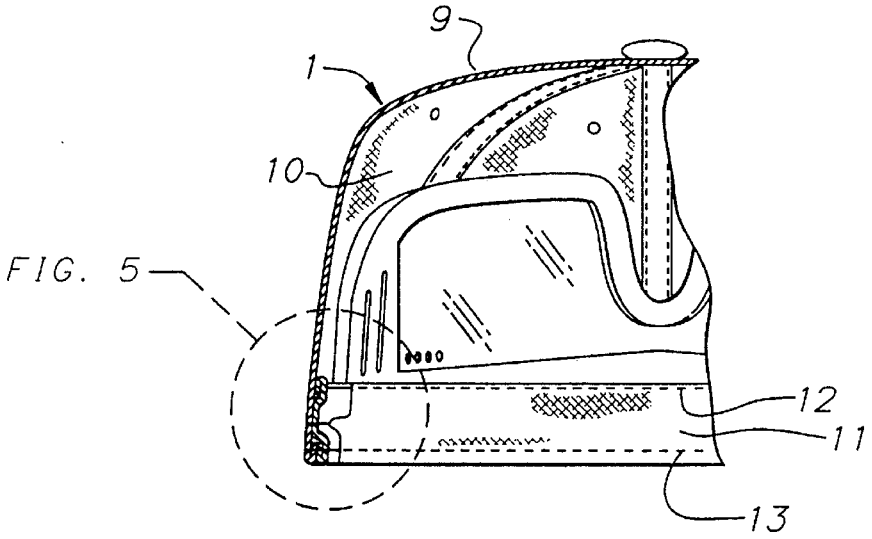
FIG. 3 is a cross-sectional view, taken along the line 3—3 of FIG. 1, and partially fragmented.

FIG. 3 is a cross-sectional view taken along line 3.3 of FIG. 1, and shows in more detail one side of the cap. In FIG. 3, the visor is positioned in its retracted or flipped-up, or inoperative position. In this position, it is invisible to the observer. It is tucked up inside the crown 9, and tends to bear against the inside surface 10 of crown 9. In FIG. 3, the general configuration of the distal edge of the visor 4 is further shown, with the indentation to accommodate the nose of the user being illustrated. The heavier gauge foam plastic material constituting part of the visor includes a visor headband 11. The visor part of the heavier gauge material surrounding the filter is shown sewed to the visor headband with stitches 12, broadly called an attachment. It is understood however that any attaching means is acceptable, and stitches 12 are shown as a typical and preferable example.

The visor headband 11 in turn is sewed, preferably, to the lower edge of the crown 9 of the cap 1 with a line of stitches 13, broadly called an attachment. As shown in FIG. 3, the stitches 12 holding the visor to the visor headband is an upper row, and the stitches 13 holding the visor headband 11 to the remainder of the cap is shown as a lower row. Another way to describe these connections with reference to the main body of the cap is to state that the stitches 13 are near the proximal edge of the visor headband 11 and the stitches 12 are near the distal edge of the visor headband 11.

Figure 4:
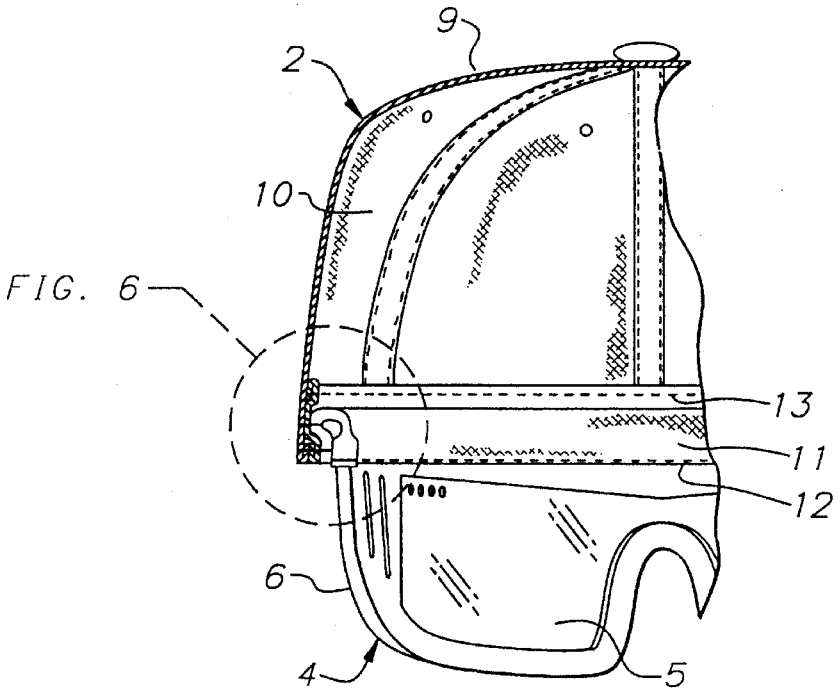
FIG. 4 is a cross-sectional view taken along line 4—4 of FIG. 2, and partially fragmented.

In FIG. 4, the cap 2 is illustrated in the same manner as FIG. 3, except that in this showing, the visor 4 is in the flipped-down or lowered or operative position. Note that the stitches 12 connecting the visor 4 to the visor headband 11 are now lower and the row of stitches 13 connecting the visor headband 11 to the main body of the cap 2 is now in the upper position. Other than as described, the structures of the cap in the position shown respectively in FIGS. 3 and 4 are the same.

Figure 5:
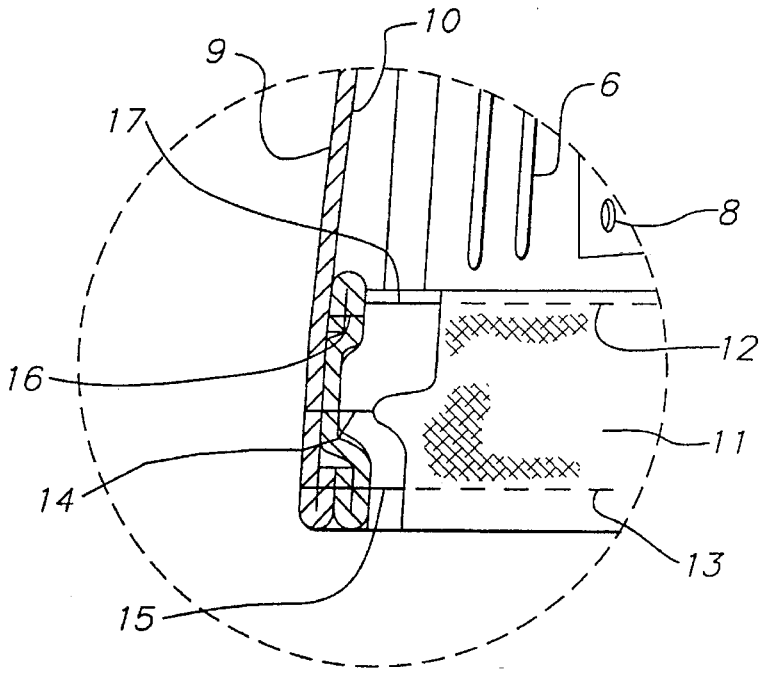
FIG. 5 is an enlarged view of the lower left hand corner of the cap of FIG. 3.
Figure 6:
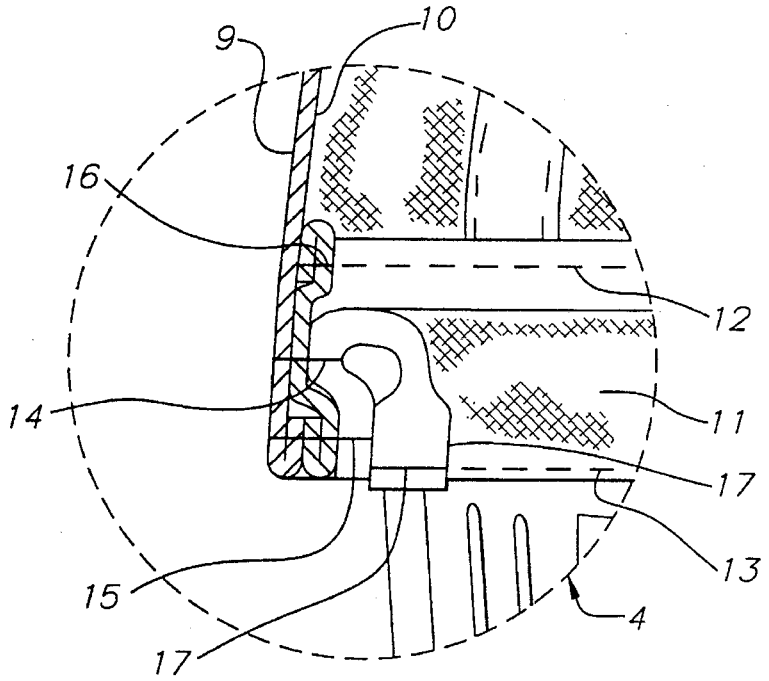
FIG. 6 is an enlarged view of the lower left hand corner of the cap of FIG. 4.

There is an important aspect of the invention which, while shown in FIGS. 3 and 4, is more clearly illustrated in the enlarged FIGS. 5 and 6.

It has been found that if the visor is simply attached to the visor headband only by the attachment or line of stitches 13 which run near the distal end of the visor headband 11, an undesirable effect tends to occur. The undesirable effect is that when the visor is flipped down out of the crown, it tends to extend in a more nearly horizontal line of extension than is desired. It is apparent that a more nearly vertical line of extension is required for the overall device to be useful.

The present invention obviates this difficulty in a manner that is best understood in connections with FIGS. 5 and 6. In FIG. 5, which is an enlarged view of the lower left hand corner of the cap shown in FIG. 3, the line of stitches 13 is shown and the last stitch in that row is designated by reference numeral 15. The line of stitches 12 which affixes the visor 4 to the visor headband 12 is shown, and the last stitch in that row is designated by reference numeral 17. An additional single stitch 14 is provided at or near the rear end of edge of the visor 4, on both sides of the cap. This additional single stitch 14 is the illustrated example of what is broadly a further intermediate attachment. As best shown in FIG. 5, this stitch 14 attaches the visor headband 11 to the main body or crown 9 of the cap at a point intermediate between the rows of stitches 12 and 13. Broadly, this is known as intermediate end attaching means 14. In the up or inoperative position as shown in FIG. 5, the intermediate end attaching means 14 has no effect.

However, when the visor is flipped to the down or operative position, as shown in FIG. 6, the end stitch or intermediate end attaching means 14 serves an important function. As clearly shown in FIG. 6, this end stitch retrains the visor headband at that point from folding completely downwardly so as to form a smooth linear extension from the main body of the visor 4. Instead, it permits only a partial down-folding of the visor headband 11 at that point. The consequence of this restraint is that the visor tends to extend vertically, as is desirable, rather than horizontally as is undesirable.

The ventilation openings 7 and 8, as best illustrated in FIG. 2, are desirable to avoid fogging of the interior of the light filter 5. However, while the provision of either or both of these ventilating means is preferable, the invention is operable without them.

It is understood that the showing of a cap in the drawings is merely illustrative for all types of headgear. It is apparent that the utility of the invention is independent of the exact specifications of the materials of which the various elements, including the headgear and the visor, and, including the filter, are made, as long as they have the apparent properties and are conventionally available. It has been found however that the existence of the heavier gauge portion 6 of the visor 4 is a highly desirable aspect of the structure.

I claim:

1. Headgear comprising a main body having a visor headband, said visor headband having a proximal edge and a distal edge, said visor headband having an attachment to said main body at said proximal edge, a visor having an attachment to said visor headband at said distal edge, said visor comprising a light filter, said visor having a stable operative position and a stable inoperative position, said inoperative position having said distal edge of said visor headband higher than said proximal edge, and said visor extending generally vertically upwardly and inside said headgear, and said operative position having said distal edge of said visor headband lower than said proximal edge, and said visor extending generally downwardly, wherein said visor headband and said visor have ends and are co-extensive around part of the circumference of said headgear, said visor headband having a further intermediate attachment to said headgear at each end of said visor headband, said further attachment being at a point intermediate between said visor headband proximal edge and distal edge respective attachments.

2. Headgear as set forth in claim 1 wherein said distal and proximal edge attachments are each rows of stitches, and said further intermediate attachments are each stitches.

3. Headgear as set forth in claim 1 wherein said visor includes an opaque portion of heavier gauge than said light filter, said opaque portion surrounding said light filter.

4. Headgear as set forth in claim 3 wherein said light filter and said surrounding opaque portion are flexible plastic.

5. Headgear as set forth in claim 4 wherein there are ventilation openings through at least one of said light filter and said opaque plastic.

6. Headgear as set forth in claim 1 wherein said headgear is a cap, and said main body includes a crown having an inner surface, and said visor when in said upwardly extending inoperative position is substantially in contact with said inner surface of said crown.

7. Headgear as set forth in claim 6 wherein said cap has a bill extending in a generally horizontal direction.

8. Headgear as set forth in claim 1 wherein said headgear is a hat.

9. Headgear as set forth in claim 8 wherein said hat has a brim.

* * * * *